US011473310B2

(12) United States Patent
Stoughton

(10) Patent No.: US 11,473,310 B2
(45) Date of Patent: Oct. 18, 2022

(54) PERFORATED EAVE TRIM AND ROOF VENTILATION SYSTEM

(71) Applicant: Terry Wayne Stoughton, Gooderham (CA)

(72) Inventor: Terry Wayne Stoughton, Gooderham (CA)

( * ) Notice: Subject to any disclaimer, the term of this patent is extended or adjusted under 35 U.S.C. 154(b) by 0 days.

(21) Appl. No.: 16/582,030

(22) Filed: Sep. 25, 2019

(65) Prior Publication Data

US 2021/0087820 A1 Mar. 25, 2021

(51) Int. Cl.

| | |
|---|---|
| ***E04D 13/15*** | (2006.01) |
| ***E04D 13/17*** | (2006.01) |
| ***E04D 13/158*** | (2006.01) |
| ***E04D 13/152*** | (2006.01) |

(52) U.S. Cl.

CPC ..... *E04D 13/178* (2013.01); *E04D 13/152* (2013.01); *E04D 13/158* (2013.01)

(58) Field of Classification Search

CPC ..... E04D 13/178; E04D 13/15; E04D 13/152; E04D 13/158

See application file for complete search history.

(56) References Cited

U.S. PATENT DOCUMENTS 4,007,672 A * 2/1977 Luckey ..... F16B 9/058 454/260
4,347,691 A * 9/1982 Lloyd-Jones ..... E04D 13/158 52/95
D271,713 S * 12/1983 Hicks ..... D23/393
5,238,450 A * 8/1993 Rotter ..... E04D 13/152 454/260
5,243,793 A * 9/1993 MacLeod ..... E04D 13/152 454/260
5,728,000 A * 3/1998 Bateman ..... E04D 13/152 454/260
5,885,153 A * 3/1999 Bateman ..... E04D 13/178 454/260
5,941,028 A * 8/1999 Hicks ..... E04D 13/152 454/260
5,950,375 A * 9/1999 Zaccagni ..... E04D 13/1585 52/11
6,026,616 A * 2/2000 Gibson ..... E04D 13/152 52/302.1
6,539,675 B1 * 4/2003 Gile ..... E04D 13/152 454/260
6,705,052 B1 * 3/2004 Larson ..... E04D 13/178 52/302.1
D502,991 S * 3/2005 Rodolfo ..... D23/393
(Continued)

FOREIGN PATENT DOCUMENTS

CA 2996249 A1 * 8/2018 ..... E04B 1/7641
FR 2962745 A1 * 1/2012 ..... E04D 13/178

*Primary Examiner* — Babajide A Demuren
(74) *Attorney, Agent, or Firm* — Capehart Law Firm

(57) ABSTRACT

A perforated eave trim and system for roofs is described. New shingles are typically installed on wooden strapping attached to an old or existing roof. The cavity between the old roof and the shingles is prone to build up of moisture if the cavity is inadequately ventilated. Moisture build up can lead to mold, ice buildup and damage to the roof and strapping. The perforated eave trim, and embodiments thereof disclosed herein, in conjunction with conventional roof vents provides an improved system for venting roofs.

19 Claims, 3 Drawing Sheets

(56) References Cited

U.S. PATENT DOCUMENTS

| | | | | |
|---|---|---|---|---|
| 8,112,945 | B2 * | 2/2012 | Austin | E04D 13/178 52/95 |
| D702,860 | S * | 4/2014 | Rice | D25/119 |
| D792,576 | S * | 7/2017 | Mayes | D23/393 |
| 2002/0124484 | A1 * | 9/2002 | Martin | E04D 13/152 52/94 |
| 2008/0016806 | A1 * | 1/2008 | Pulte | E04F 13/076 52/287.1 |
| 2008/0072503 | A1 * | 3/2008 | Brochu | E04D 13/152 52/94 |

* cited by examiner

PERFORATED EAVE TRIM AND ROOF VENTILATION SYSTEM

REFERENCE TO PENDING APPLICATIONS

This application does not claim the benefit of pending application.

BACKGROUND OF THE INVENTION

1. Field of the Invention

This invention relates to roof ventilation systems and more particularly to an edging system for roofs to create airflow from the edge of the roof to the peak.

2. Description of the Related Art

It is widely accepted that properly ventilated roofs provide the essential year around functions of eliminating moisture condensation problems, reducing heat buildup during hot weather, and preventing ice dams during cold weather.

Roofs are typically installed over the existing felt or wooden shingle roofs. This practice is convenient and wooden strapping being attached to the existing roof and the shingles attached to the strapping. The main purpose of roof ventilation is to remove moisture from air in the space air between the existing roof and the new shingles. Both interior air moisture and external air moisture contribute to the total moisture content in gap between the old and new roof. Sources of interior air moisture include slab moisture, washers, dryers, showers, dishwashers, and normal living processes of the inhabitants that permeate through the old roof. External air moisture is caused by humidity and precipitation. The moisture, once in the space between the old and the new roof, will condense on the upper cooler roof to form water, frost, or ice. The moisture can then lead to the formation of mold. The moisture can also cause parts of the roof to rust, typically around the drill holes in the shingles that have been drilled to screw the shingles to the wooden strapping. A properly ventilated space in this type of double skinned roof will prevent these problems, indeed all building codes now require some type of roof ventilation.

Numerous roof ventilation systems have been proposed such as soffit vents, continuous louvered metal strips, gable vents, electrical powered vents, and continuous drip edge soffit starter vents. Most of the systems indicated below, however, are specifically designed for conventional felt or wooden shingles and therefore do not adequately address the specific problems associated with ventilation in the space created between an old conventional roof and a new shingle roof, for example:

US20050138865A1 EAVE LINING SYSTEM. The eave lining system includes an eave lining sheet pre-finished on at least one exposed surface and securing means for affixing the eave sheet to a support surface. The eave sheet and securing means are configured such that minimal post installation finishing is required. In a preferred form, the system includes a pre-finished corner trim system for concealing and finishing the joint between the eave lining sheet and the adjacent building surface. The trim system can be a two-part system including an inner core element that is secured to the eave support structure or adjacent building surface, and an outer pre-finished clip on cover element. The cover element can be made of standard straight length sections and custom pre-formed corner pieces that sit over the ends of the straight sections. One or more components of the system include openings or perforations configured to provide a predetermined amount of ventilation to selected parts of the building. Preferably, the openings or perforations are provided in one or more of parts selected from the group consisting of eave lining sheets, sheet joining strips, and trim components. The eave lining sheets may also be perforated through their thickness with a predetermined number and arrangement of slots, holes, or other types of perforation. These perforations provide a predetermined amount of airflow through the sheet, in turn providing ventilation to the roof or wall cavity when the sheet is installed.

U.S. Pat. No. 5,728,000A EAVE VENT. The invention provides a one piece continuous roof edge vent supplying air-inlet ventilation continuous with the roof edge thereby maximizing air circulation in the roof space and minimizing dead air pockets and attic air moisture content. The invention also provides a continuous roof drip edge soffit vent which reduces attic air space moisture, dead air pockets, and roof ice damming.

CA2490670C HIDDEN VENTILATION TRIM ACCESSORY. A trim accessory is described which includes a soffit receiver component, a siding accessory receiver component and vent apertures. The vent apertures are capable of being substantially hidden from view at least when the trim accessory is installed on a building and a soffit and siding accessory are received into the corresponding soffit receiver component and siding accessory receiver component. The vent apertures may be located on edge, or along the connecting edge, or any other location on the vent component which facilitates air circulation behind the soffit panels. The siding accessory receiver component may also include vent apertures for facilitating air circulation and air movement.

U.S. Pat. No. 6,539,675B1 TWO-PIECE VENTED CORNICE DEVICE. The means for discharging water from the cornice device comprises a water trough and a plurality of apertures formed in the connector member, the crown member, or both. The apertures are configured to allow water to pass therethrough and also act as a means for ventilating a building structure. The ventilating apertures should be of sufficient size to allow the water to draw freely out from the interior of building structure through cornice device, while allowing a sufficient quantity of air to flow into building structure.

U.S. Pat. No. 5,035,172A ROOF VENTILATING APPARATUS. The invention relates generally to ventilation of building spaces under roofs and like structures and more particularly to apparatus used to ventilate roofs through gables. A gable ventilator comprising a vent member which holds and displaces an eaves panel and a bracket which positions and supports the vent member is disclosed. The vent member is provided with a plurality of apertures through which air may pass, is configured to extend the length of the gable wall. The gable ventilator of the present invention achieve these objectives by providing an assembly of an apertured vent member configured to receive and project an eaves panel out of the plane of the roof gable and a bracket which cooperates with the vent to position and secure the vent to the gable. The ventilator may used on a single eaves panel or may installed in several eaves panels. This ventilator has advantages over previous louvered apparatus in that it permits ventilation along the length of the gable in one or several positions, and thus allows great control over the rate at which air passes through the gable. Furthermore, the gable ventilator is provided with fiberglass mesh filter which effectively excludes wasps, bees, termites and like pests.

EP0732462B1 ROOF VENTILATING TRIM, IN PARTICULAR WITH ANTI-VEGETATION EFFECT. The invention relates to a ventilation element for roofs. To the ridge is allocated a resilient sealing material that is air permeable and preferably contains mutually movable elements. Typically, the air permeable material is formed by a metal fabric, a metal mat, wire mesh, wire element, or an element with metal platelets.

U.S. Pat. No. 7,424,790B2 VENTED EAVES CLOSURE. A method is provided for installing a ventilated eaves closure and tile support apparatus along the eaves of a roof. A vented eaves closure apparatus is disposed along the eaves to support the first course of roof tiles at a desired pitch. The apparatus provides support, ventilation, and drainage, while also providing a barrier to wind-driven precipitation, bird nesting, and animal invasion. The apparatus includes an array of openings configured to allow drainage and facilitate the flow of air beneath the tiles and throughout the air space between the roof deck and the tiles. The method and apparatus can be adapted to fit a variety of roof types and roof tiles having different sizes, shapes, and profiles. A cavity defined by the roof decking, roof tiles, eaves closure, and peak, and an array of openings through said eaves closure sized and shaped to promote a circulation of air within said cavity. The system may also include an air mover positioned to draw air through said cavity.

US20090183453A1 APPARATUS FOR PROVIDING AIR FLOW IN A BUILDING WALL. An inter-panel ventilation apparatus is installed in a building wall between rows of siding, for providing air flow to and from an interstitial space between exterior and interior building wall layers. The inter-panel ventilation apparatus has a hood for carrying away water to an exterior of the building wall, and upper and lower apertured venting components respectively engaged with adjacent upper and lower siding panels. A plurality of inter-panel ventilation apparatus may be connected together with couplers to form a ventilation trim extending along a length of the building wall.

US20100132288A1 TOP SIDED VENTED TRIM FOR EXTERIOR CLADDING SYSTEM. A trim member for an exterior wall cladding system of a residential or commercial building is provided. The trim member includes a nailing flange, a top flange extending perpendicularly from the top of the nailing flange, a front leg extending downwardly from the exterior end of the top flange, a vent leg projecting inwardly from the front leg, and a return leg extending upwardly toward the top flange. The vent leg may be perforated to allow the passage of air and moisture out of the trim member and oriented so that rain water cannot enter directly into the trim member. The trim member permits the wall cladding system to drain and ventilate, thereby removing unwanted water and moisture vapor or condensation from within the cladding system. The trim member may be installed on an exterior building wall beneath the soffit prior to the application of a wall cladding system. The trim member allows the wall cladding system to drain and ventilate, thereby removing unwanted water and moisture from within the cladding system. Additionally, the trim member advantageously allows air to enter the bottom of the wall and exit at the top without any interruptions.

U.S. Pat. No. 7,318,282B2 PULTRUDED TRIM MEMBERS. The invention is an improved method of making cornice assemblies and other trim members utilizing the process of pultrusion. The cornice assemblies and the other trim members made by the method of the present invention exhibit superior strength to weight ratios, low expansion and contraction due to changes in temperature and humidity, as well being less labor intensive to install. One or more vent holes may be made in the soffit allow circulation of air and escape of moisture. These vent holes may be made shortly after the time of fabrication of the pultruded member or at the job site, as dictated by the needs of the installer. Vent holes in the soffit, are shown in a longitudinal view of the soffit portion of trim member U.S. Pat. No. 7,836,642B2 ROOF EDGE WINDSCREEN. An assembly attached to the roof perimeter to mitigate wind-generated vortices and uplift loads on the roof perimeter area of a building, applicable for both new constructions and retrofits of existing buildings. The assembly comprises an overhung screen portion preferably having face perforation and outer edge serration for equalizing pressure and disorganizing shear layer vorticity, and thus disrupting vortex formation. A roof edge windscreen is generally mounted onto an existing fascia or bargeboard. As an option appropriate for new constructions, it can also be mounted directly onto a framing member in place of fascia or bargeboard. The perforation is made with a plurality of through-holes on the sheet material. The specific layout, number, shapes and sizes of the distributed through-holes are not of primary significance, as long as the overall porosity resulting from the face perforation is in a preferred range approximately between 25% and 75% to provide desired air-permeability.

U.S. Pat. No. 7,137,224B2 VENTED SOFFIT PANEL AND METHOD FOR BUILDINGS AND LIKE. A vented soffit panel and related method for buildings and the like includes a generally flat imperforate base portion shaped to enclose at least a portion of the building soffit when mounted in a generally horizontal orientation under an eave. At least one vent channel protrudes upwardly from the base portion, and has a generally trapezoidal shape defined by a horizontal imperforate top wall and inclined perforate sidewalls with lower ends that connect with the base portion in a spaced apart relationship to define a slot through which air flows to vent the eave. The perforate sidewalls are disposed at an acute angle, such that they are hidden from view from a position underneath the eave. Inclined perforate sidewalls with lower ends that connect with base portion 2 in a spaced apart relationship to define a slot 9 through which air flows to vent eave. The perforate sidewalls are disposed at an acute angle relative to top wall 6 and base portion 2, such that they are hidden from view from a position underneath the eave.

The devices described above each have one or more unfavorable features, or lack an advantageous feature, which render the devices unsuitable in some respect for use as an venting system for use with a new shingle roof when applied directly on top of an existing roof structure.

Thus, it would be advantageous in the art to provide a device, for use in conjunction with a conventional roof vent, that would improve ventilation beneath the shingles. Such a system would be expected to alleviate the problems associated with inadequate ventilation, such as mold, ice buildup and damage to the roof and strapping.

SUMMARY OF THE INVENTION

In accordance with an aspect of the invention there is provided a perforated eave trim for use on buildings having a vertical exterior surface and an inclined double layer roof structure having a ridge, and inner and outer surfaces, said perforated eave trim comprising: a) an elongated planar upper panel configured for disposition on an eave trim supporting member positioned at a lower edge of the roof structure; b) an elongated planar lower panel structured for abutable attachment to the vertical exterior surface of the building; and c) an elongated planar middle panel positioned between said upper and lower panels, said middle panel having a series of perforations disposed along its length and connected to said upper panel by a first angled bend and connected to said lower panel by a second angled bend, wherein said perforated eave trim provides for air circulation between the inner and outer surfaces of the double layer roof structure.

In accordance with an additional aspect of the invention there is provided a roof ventilation system for use on buildings having a vertical exterior surface and an inclined double layer roof structure, said double layer roof structure having a ridge, an outer surface, an inner surface, and a cavity between the surfaces, said system comprising: i) a ventilation means situated in close approximation to the ridge on the outer surface of the roof; and ii) a perforated eave trim, said eave trim comprising: a) an elongated planar upper panel configured for disposition on a supporting member of the outer surface of the inclined double layered roof structure; b) an elongated planar lower panel structured for abutable attachment to the vertical exterior surface; and c) an elongated planar middle panel positioned between said upper and lower panels, said middle panel having a series of perforations disposed along its length and connected to said upper section by a first angled bend and connected to said lower section by a second angled bend, wherein said perforated eave trim, in cooperation with the ventilation means, provides for air circulation in the cavity between the inner and outer surfaces of the roof structure and the ventilation means.

In accordance with an aspect of the invention there is provided a perforated eave trim wherein the outer surface are shingles.

In accordance with an additional aspect of the invention there is provided a perforated eave trim wherein the inner surface is an existing roof structure.

In accordance with yet a further aspect of the invention there is provided a perforated eave trim wherein the perforations are selected from slits, slots, holes, and louvered slits.

The advantages and features of the present invention will become better understood with reference to the following more detailed description and claims taken in conjunction with the accompanying drawings in which like elements are identified with like symbols.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

The invention relates to a perforated eave trim and system for venting roofs to create airflow from the edge of the roof to the peak. More specifically to a perforated eave trim that promotes airflow throughout the roof preventing ice buildup and damage to the roof and eaves.

In one embodiment, wood strapping is attached to an existing roof and shingles are attached to the wood strapping. The space formed around the wood strapping, between existing roof and the shingles, and is vented between the perforated eave trim and a roof mounted ventilation means to establish airflow between the double layer roof structure. The perforated eave trim is installed along the lower edge of the roof structure, spanning the gap between the existing roof and the shingles. Air is then taken in through the perforated portion of the eave trim and rises inside, between the two layers of the double layer roof structure, then expelled at the peak through a roof vent. The perforated eave trim therefore promotes airflow throughout the roof preventing ice buildup and damage to the roof and eaves.

Figure 1:
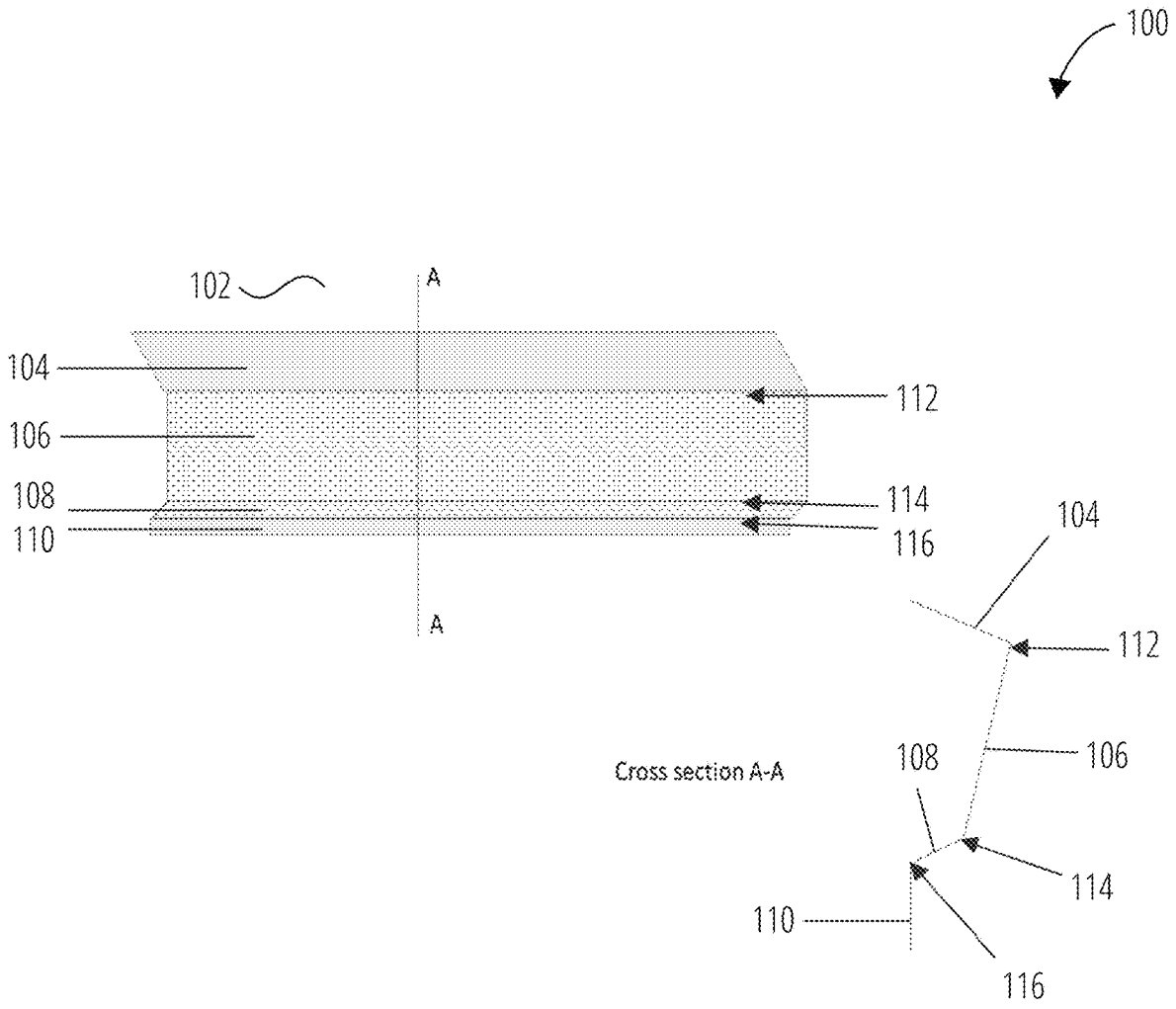
FIG. 1 is a perspective, and corresponding cross sectional, view of an embodiment of the invention.

FIG. 1 illustrates an embodiment of the invention 100. The perforated eave trim is generally indicated at 102. The elongated planar upper panel 104 is connected to the elongated perforated planar middle panel 106 by the first angled bend 112. The elongated perforated planar middle panel 106 is connected to the elongated angled middle panel 108 by the second angled bend 114. The elongated angled middle panel 108 is connected to the elongated planar lower panel 110 by the third angled bend 116. While the middle panel 108 is shown to be connected to the lower panel 110, such is illustrative and not meant to be limiting. In some embodiments, the perforated eave trim 102 does not include a lower panel 110.

Cross section A-A illustrates approximate angles of the bends. For example, the first angled bend 112 forms an approximate angle of 90 degrees between elongated planar upper panel 104 and elongated perforated planar middle panel 106. The second angled bend 114 and third angled bend 116 are correspondingly selected such that when elongated planar upper panel 104 is attached to wooden strapping on the roof, the elongated planar lower panel 110 is essentially parallel to the vertical side of the building.

In this particular embodiment, the elongated angled middle panel 108 may optionally be perforated.

Figure 2:
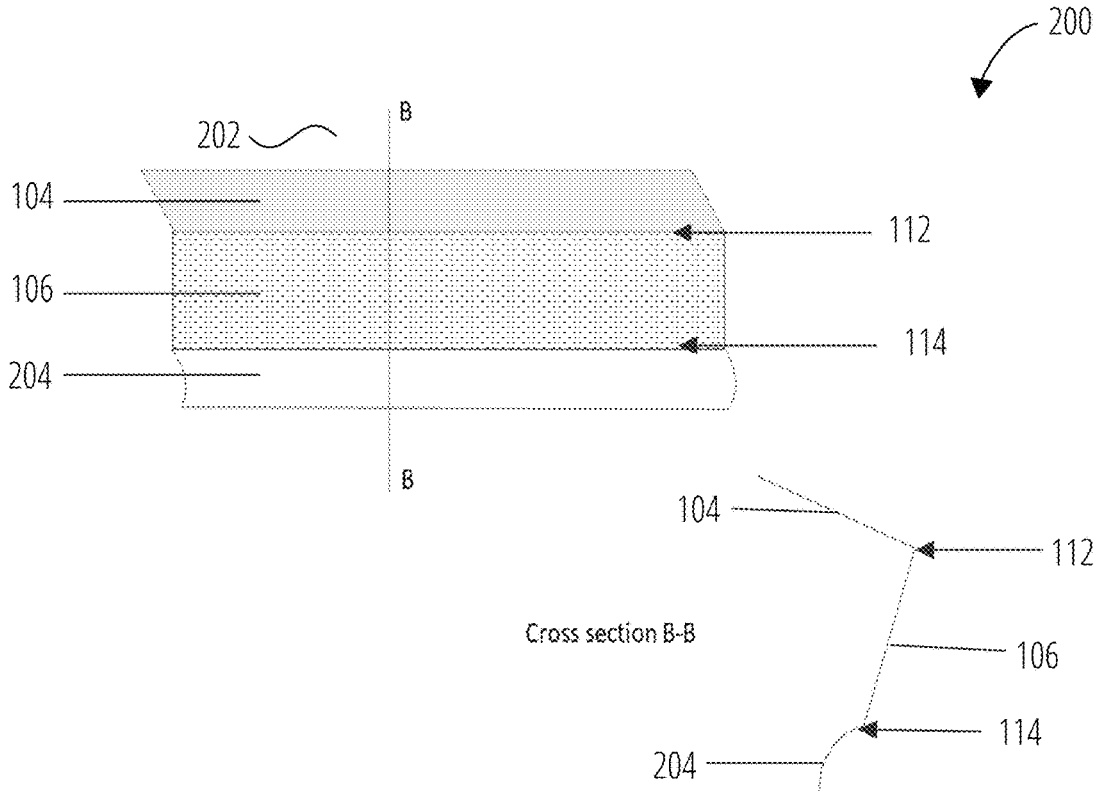
FIG. 2 is a perspective, and corresponding cross sectional, view of an additional embodiment of the invention.

FIG. 2 illustrates an embodiment of the invention 200. The perforated eave trim is generally indicated at 202. The elongated planar upper panel 104 is connected to the elongated perforated planar middle panel 106 by the first angled bend 112. The elongated perforated planar middle panel 106 is connected to the elongated contoured lower panel 204 by the second angled bend 114.

Cross section A-A illustrates approximate angles of the bends. For example, the first angled bend 112 forms an approximate angle of 90 degrees between elongated planar upper panel 104 and elongated perforated planar middle panel 106. The second angled bend 114 is selected such that when elongated planar upper panel 104 is attached to wooden strapping on the roof, the lower edge of the elongated contoured lower panel 204 is essentially parallel to the vertical side of the building.

In this particular embodiment, the elongated contoured lower panel 204 may optionally be perforated.

Figure 3:
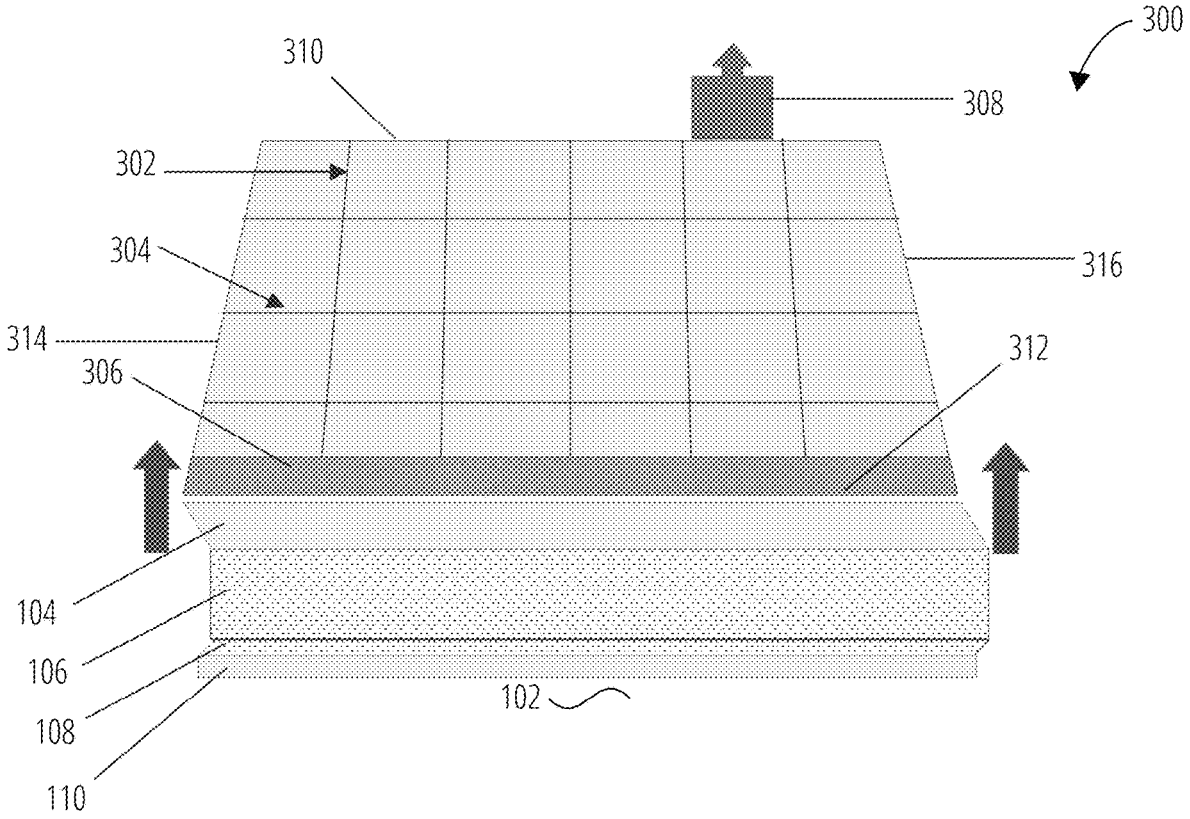
FIG. 3 illustrates a typical installation of a perforated eave trim on a roof in accordance with an embodiment of the invention.

FIG. 3 illustrates a typical installation of an eave trim on a roof 300. Vertical wooden strapping members 302 and horizontal wooden strapping members 304 are applied to an existing roof structure. An eave trim attachment member 306 is secured to the lower edge of roof 312. The elongated planar upper panel 104 of the perforated eave trim 102 is then attached to the lower edge of roof 312. The elongated planar lower panel 110 is then secured to a vertical wall of the building.

Shingles can then be installed on the roof 300, securing them in place on the vertical wooden strapping members 302, the horizontal wooden strapping members 304, and the elongated planar upper panel 104. The shingles are sealed along the roof ridge 310 and the 314 and second gable end 316. A roof vent 308 is installed on the roof 300.

The elongated perforated planar middle panel 106 allows air to circulate beneath the existing roof and the shingles and exit the roof cavity via the roof vent 308.

The invention described herein, and illustrated by reference to the various embodiments, encompasses numerous different combinations and orientations of planar members that are sized to fit along the lower eave edge of a roof on buildings having a vertical wall and an inclined double layer roof structure.

The elongated planar upper panel 104 is designed to attach the perforated eave trim 102 to the lower edge of roof 312, typically by screws driven through holes drilled at appropriate places in the elongated planar upper panel 104. The shingles then being attached to the elongated planar upper panel 104 of the perforated eave trim 102 after it has been attached to the lower edge of roof 312. This arrangement provides a waterproof seal between the shingles and the elongated planar upper panel 104.

The first angled bend 112, the second angled bend 114 and the third angled bend 116 can be configured such that when the elongated planar upper panel 104 is affixed to the lower edge of roof 312, the elongated planar lower panel 110 is positioned such that it can be attached to a vertical exterior surface of a building, or siding or similar covering. The means of attachment of the elongated planar lower panel 110 to the vertical exterior surface is typically by screws driven through holes drilled at appropriate places in the elongated planar lower panel 110.

The eave trim can be configured to have perforations in one or more of the planar panels. The perforations can be horizontal or vertical, and the apertures can include, but are not limited to; slits, slots, holes, and louvered slits.

It is contemplated that any of the embodiments of the described perforated eave trim 102 can be configured with any conventional roof vent 308, including but not limited to vents selected from box, wind, ridge, off ridge, power, cupola, soffit, power and static.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

I claim:

1. A perforated eave trim for use on building having a vertical exterior surface and an included double layer roof structure having a ridge, and inner and outer surfaces, said perforated eave trim comprising:

an elongated planar upper panel configured for disposition on an eave trim supporting member positioned at a lower edge of the roof structure;

an elongated planar middle panel having a series of perforations disposed along its length and connected to said elongated planar upper panel by a first angled bend;

an elongated angled middle panel having a series of perforations disposed along its length and connected to said elongated planar middle panel by a second angled bend, said elongated planar middle panelg positioned between said elongated planar upper panel and said elongated angled middle panel; and an elongated planar lower panel structured for abutable attachment to the vertical exterior surface of the building, said elongated planar lower panel connected to said elongated angled middle panel by a third angled bend, said elongated angled middle panel being positioned between said elongated planar lower panel and said elongated planar middle panel, wherein said perforated eave trim provides for air circulation between the inner and outer surfaces of the double layer roof structure.

2. The perforated eave trim of claim 1, wherein the upper panel, middle panel and lower panel are a one-piece unitary structure.

3. The perforated eave trim of claim 1, wherein the lower panel has a series of perforations disposed along its length.

4. The perforated eave trim of claim 1, wherein the eave trim supporting member is attached to an outer edge of the outer surface of the double layer roof structure.

5. The perforated eave trim of claim 1, wherein said disposition on the eave trim supporting member consists of a series of holes drilled in the upper panel sized to accommodate screws.

6. The perforated eave trim of claim 1, wherein the first angled bend in approximately 90 degrees.

7. The perforated eave trim of claim 6, wherein the second angled bend and the third angled bend are i-s selected such that the lower panel forms said abutable attachment to the vertical exterior surface of the building.

8. The perforated eave trim of claim 1, wherein the second angled bend and third angled bend are selected such that the lower panel forms said abutable attachment to the vertical exterior surface of the building.

9. The perforated eave trim of claim 1, wherein the outer surface is shingles.

10. The perforated eave trim of claim 1, wherein the inner surface is an existing roof.

11. The perforated eave trim of claim 1, wherein the perforations are selected from the group comprising slits, slots, holes and louvered slits.

12. The perforated eave trim of claim 1, wherein a ventilation means is mounted in close approximation to the ridge on the outer surface of the roof, said vent being in communication with the eave trim.

13. The perforated eave trim of claim 12, wherein the ventilation means is selected from box vent, wind vent, ridge vent, off ridge vent, power vent, cupola vent, soffit vent, power vent and static vent.

14. A roof ventilation system for use on building having a vertical exterior surface and an included double layer roof structure having a ridge, said double layer roof structure having a ridge, an outer surface, an inner and a cavity between the surfaces, said system comprising:

a ventilation means situated in close approximation to the ridge on the outer surface of the roof; and a perforated eave trim, said eave trim including an elongated planar upper panel configured for disposition on a supporting member of the outer surface of the inclined double layered roof structure, an elongated planar middle panel having a series of perforations disposed along its length and connected to said elongated planar upper panel by a first angled bend, an elongated angled middle panel having a series of perforations disposed along its length and connected to said elongated planar middle panel by a second angled bend, said elongated planar middle panel being positioned between said elongated planar upper panel and said elongated angled middle panel, and an elongated planar lower panel structured for abutable attachment to the vertical exterior surface, said elongated planar lower panel connected to said elongated angled middle panel by a third angled bend, said elongated angled middle panel being positioned between said elongated planar lower panel and said elongated planar middle panel, wherein said perforated eave trim, in cooperation with the ventilation means, provides for air circulation in the cavity between the inner and outer surfaces of the roof structure and the ventilation means.

15. The perforated eave trim of claim 14, wherein the outer surface is shingles.

16. The perforated eave trim of claim 14, wherein the inner surface is an existing roof.

17. The perforated eave trim of claim 14, wherein the ventilation means is selected from box vent, wind vent, ridge vent, off ridge vent, power vent, cupola vent, soffit vent, power vent and static vent.

18. The perforated eave trim of claim 14, wherein the lower panel has a series of perforations disposed along its length.

19. The perforated eave trim of claim 14, wherein the perforations are selected from the group comprising slits, slots, holes and louvered slits.

* * * * *